United States Patent [19]

Berstein et al.

[11] Patent Number: 4,766,753

[45] Date of Patent: Aug. 30, 1988

[54] ROLLING APPARATUS FOR SURFACE HARDENING OR SMOOTHING

[75] Inventors: Garri Berstein; Willi Hansen, both of Erkelenz; Rudolf Winkens, Erkelenz-Gerderath, all of Fed. Rep. of Germany

[73] Assignee: W. Hegenscheidt GmbH, Erkelenz, Fed. Rep. of Germany

[21] Appl. No.: 902,152

[22] Filed: Aug. 29, 1986

[30] Foreign Application Priority Data

Aug. 30, 1985 [EP] European Pat. Off. ..... 85110946.2
Jan. 14, 1986 [EP] European Pat. Off. ..... 86100404.2

[51] Int. Cl.[4] ..... B21K 1/08
[52] U.S. Cl. ..... 72/110
[58] Field of Search ..... 27/6; 72/81, 110, 111

[56] References Cited

U.S. PATENT DOCUMENTS 4,437,328 3/1984 Wittkopp et al. ..... 72/110
4,559,798 12/1985 Hayashi et al. ..... 72/81

*Primary Examiner*—Lowell A. Larson
*Attorney, Agent, or Firm*—Herbert L. Lerner; Laurence A. Greenberg

[57] ABSTRACT

Surface-hardening and smoothing rolling apparatus includes at least one movable rolling device at least including a die carrier with at least one backing element, as well as at least one additional rolling device, the movable and additional rolling device being carried by a standard disposed on a slide, the movable rolling device being arranged so that the position thereof is changeable relative to that of the additional rolling device in a radial plane of a crankshaft to be rolled.

34 Claims, 6 Drawing Sheets

ROLLING APPARATUS FOR SURFACE HARDENING OR SMOOTHING

The invention relates to a rolling apparatus for surface hardening and smoothing having at least one movable rolling device at least including a die carrier with at least one rolling element, and a die carrier with at least one backing element, as well as at least one additional rolling device, the rolling devices being supported by a standard disposed on a slide or carriage.

Apparatuses of the aforedescribed general type are known and have proven out well in practice. They can be constructed so that they can be placed as so-called attachments onto the bed carriage of a lathe or a machine similar to a lathe. The lathe can then seat or receive a workpiece to be rolled, preferably a crankshaft to be rolled, in a chuck at one end and in the tailstock center at the other end, clamp or chuck it and then drive it. The required rolling device is then fed manually with its dies to the bearing location to be rolled, the necessary rolling force is applied and the lathe is started up. Because of its pendulous suspension, a rolling device for piston rod journals which are to be rolled is driven in the process by the piston rod bearing. In the rest position thereof, the rolling device is kept in balance by spring elements.

It is an object of the invention to provide an apparatus of the type described at the introduction hereto which makes it possible to adapt the rolling devices with the rolling dies at least to different crankshaft types and at least with respect to the crankshaft stroke thereof.

With the foregoing and other objects in view, there is provided, in accordance with the invention, a surface-hardening and smoothing rolling apparatus comprising at least one movable rolling device at least including a die carrier with at least one backing element and a die carrier with at least one rolling element, as well as at least one additional rolling device, the movable and additional rolling device being carried by a standard disposed on a slide, the movable rolling device being arranged so that the position thereof is changeable relative to that of the additional rolling device in a radial plane of a crankshaft to be rolled. Such an arrangement of the rolling devices permits an adaptation to different stroke length of the bearing locations of a crankshaft through the change in position of the movable rolling devices in the respective radial plane. This ensures a stroke adaptation for those attachments having at least two rolling devices.

In accordance with another feature of the invention, the movable rolling device is arranged so that the position thereof is changeable linearily in at least two independent coordinate directions in the radial plane. A relatively simple construction for performing a desired change in position is thereby afforded.

In accordance with a further feature of the invention, at least one movable rolling device is disposed so as to be movable in a coordinate direction perpendicularly to the radial plane. A problem-free adaptation to different spacings of the surfaces to be machined in axial direction is thereby able to be provided.

In accordance with an added feature of the invention, at least one movable rolling device is arranged so that the position thereof is changeable in the radial plane independently of movement of the slide. A further simplification of the construction is achieved thereby and at the same time, a possibility is afforded for engaging and disengaging the rolling devices without changing their position relative to one another.

In accordance with an additional feature of the invention, there is provided a vertically movable and adjustable support element for carrying said rolling devices. This construction permits an adjustment of the rolling devices in vertical direction while the rolling devices retain their position relative to one another at least in vertical direction. This ensures an adaptation to different journal diameters of the workpiece.

In accordance with still another feature of the invention there are provided, slide means for performing a change in position of at least the movable rolling device. Slide or carriage constructions have proven out well especially for the execution of linear position changes, and production and maintenance thereof are reliably controlled.

In accordance with still a further feature of the invention, the movable rolling device is arranged so that the position thereof is changeable relative to the additional rolling device in axial direction of the crankshaft. This again makes for a simplification of the construction and ensures, on the other hand, that the entire apparatus is kept in unchanged position in axial direction while an adaptation to different axial positions of the workpiece surfaces to be machined is performed with the movable rolling device.

In accordance with still an added feature of the invention, the slide means are disposed on a slide carrier which is, in turn, disposed on a support element, the support element being disposed on the standard. Such a construction affords the desired mobility and is relatively easy to produce. The construction utilizes proven structural elements, the production of which is well controlled, on the one hand, and ensures great functional reliability, on the other hand.

In accordance with still an additional feature of the invention, the support element is vertically movable and adjustable on the standard. This permits a vertical adjustment by relatively simple means.

In accordance with yet another feature of the invention, the movable rolling device is suspended from a pivot arm so as to be pivotable about a first pivot pin parallel to the axis of the crankshaft, the pivot arm, in turn, being suspended from the apparatus so as to be pivotable about a second pin parallel to the first pin. This construction permits a relatively simple, pendulous suspension of the rolling devices and makes the retraction into a retracted position possible without having to move the entire apparatus for this purpose.

In accordance with yet a further feature of the invention, the standard and the support element are constructed as a clyindrical guide, the support element being axially displaceable yet constrained against rotation relative to the standard. This is a particularly simple construction for attaining the desired mobility and adjustability.

In accordance with yet an added feature of the invention, the second pivot pin continues as a cylindrical guide and forms another slide displaceably guided in a corresponding bore formed in the first-mentioned slide. Here again, the use of a circular guide simplifies the construction and production considerably.

In accordance with still another feature of the invention, two fluid cylinders operatively act upon the pivot arm in opposite directions for pivoting the pivot arm into a given position and maintaining it there so as to lock the pivot arm in the given position. The desired locking action is thus affected in an elegant and simple manner. Unobservable mass accelerations when positioning and subsequently locking the pivot arm and corresponding, disagreeable reactions upon the entire machine are thereby avoided.

In accordance with still a further feature of the invention, one of the two fluid cylinders has a first end position defining a first pivoted position and a second end position defining a second pivoted position of the pivot arm, the other of the fluid cylinders being operative with less force than the one fluid cylinder at least for locking in the first pivoted position. This certainly is the simplest imaginable possibility for arriving at and locking in two desired positions.

In accordance with still an added feature of the invention, a lever pivotally mounted on the pivot arm and actuatable by a fluid cylinder is likewise disposed on the pivot arm, the lever having a free end pressable against the rolling device associated therewith in order to bring the rolling device into a given pivoted position. With these relatively simple means it is possible to avoid any necessity for balancing the rolling device e.g. by means of springs, and the rolling device is kept by simple means, yet reliably, in the correct pivoted position for a new setup or positioning. It is important and emphasized, however, that the center of gravity of the surface-hardening rolling device be located in front of the pivot axis of the surface-hardening rolling device on the pivot arm so that a definite or unequivocal direction of movement or pivoting direction of the surface-hardening rolling device is determined.

In accordance with a supplementary feature of the invention, the rolling carriage is in combination with and disposed on a bed carriage of a machine for receiving and driving a crankshaft, the apparatus and the bed carriage being movably mounted on the bed of the machine. In this way, it is additionally possible, when necessary, also to adapt the position of all of the rolling devices in axial direction in order, for example, to roll all bearing locations of a multiple-stroke crankshaft in succession.

In accordance with still an additional feature of the invention, wherein at least an additional one of the elements consisting of a rolling element and a backing element is carried by at least one of the die carriers, at least one rolling element being changeable into at least two positions of which at least one position is a working position, and at least one of the elements is connectible kinematically to a power actuator. Due to the fact that the respective rolling device is movable and connected to only one power actuating device, care is taken that the rolling force acts upon the workpiece only as a transverse force and is mutually cancelled out there. Additional transverse forces which could stress the workpiece and which stem from the power actuating device are avoided to a great extent. The presence of at least one additional rolling element and/or backing element having a position which is changeable in the manner described makes a die change unnecessary or superfluous for appropriate workpieces so that time is gained thereby in the production of larger lots. At the same time, greater flexibility of the machine is obtained thereby, because the machine according to the invention can react, within certain limits, to the workpiece construction through an appropriate change in position of the rolling elements and/or the backing elements. It is also imaginable to employ fewer rolling devices in a single apparatus and to feed them to the respective workpiece location to be rolled, thereby making a selection by appropriately repositioning the backing elements and/or the rolling elements so that a suitable die is applied to the respective workpiece site.

In accordance with another feature of the invention, at least one of the elements consisting of the rolling element and the backing element is arranged so as to be changeable in position on the respective carrier. Due to the fact that at least one rolling element and/or backing element is disposed on the die carrier so as to be changeable in position, the construction of the machine can be simplified, at least for certain applications and, at the same time, the insertion of a workpiece into the machine can be facilitated through this changeability of position. The position changeability succeeds not only in bringing different elements to the working site when needed or desired, but also success is achieved in removing corresponding elements from the working site and returning them to the working site after a workpiece has been inserted.

In accordance with a further feature of the invention, the rolling element and the backing element, respectively, is an element of a roller head. Roller heads with rolling elements are already known and have proven out well. The use of such roller heads in a machine of the type according to the invention increases the efficiency of such a machine further in that the spare parts inventory can be reduced and restricted essentially to the roller heads. In addition, the use of such roller heads ensures a simpler construction of the machine.

In accordance with other features of the invention, an independent roller head is provided for each rolling element or rolling element pair and/or for each backing element or backing element pair. This ensures the standardization of the roller head construction so that identical roller heads can always be used even in machines having different number of rolling elements so that the different number of rolling elements is obtained simply by varying the roller heads.

In accordance with an added feature of the invention, each of the roller heads is so disposed on a die carrier associated therewith as to be changeable in the position thereof. This provides a relatively simple way of bringing the respective roller head into a desired position.

In accordance with an additional feature of the invention there is provided a die holder provided on at least one of the die carriers, the die holder being changeable from one to another pre-determinable position, with at least one element of the rolling element and the backing element being movable into the positions by means of the die holder, at least one of the elements in working position being connectible kinematically to the power actuating device. A die holder which is changeable in position and equipped with appropriate rolling elements and backing elements, respectively, is relatively easy to realize structurally. Success is thereby achieved in supporting and guiding rolling elements and backing elements at the same time.

In accordance with yet another feature of the invention, the die holder is constructed as a roller head for the element. The idea behind the invention is thus able to be realized even when space conditions are cramped. At the same time, the overall construction is simplified thereby.

In accordance with an alternate feature of the invention, at least one die holder carries at least one roller head. This makes it possible, on the one hand, to equip the machine differently when adapting it to certain production conditions and, on the other hand, success is achieved, at least in part, by using roller heads which are already available.

In accordance with yet a further feature of the invention, there are provided at least two roller heads disposed so as to be changeable into a plurality of positions, at least one of the positions being the working position. With a simple arrangement of this kind, it is possible to handle a multiplicity of different workpiece dimensions.

In accordance with an alternative feature of the invention, the roller heads are disposed on a guideway for changing the position thereof. This is a simple and space-saving construction for executing a change in position. Together with the roller heads, the rolling elements and/or the backing elements are then changed in position thereof at the same time.

In accordance with yet added features of the invention, there are provided actuating means for performing the change in position of the roller heads and, in fact, such actuating means are at least one fluid-actuated piston/cylinder unit. Actuating devices or actuators engineered specifically for executing a change in position and constructed and disposed accordingly are simple to realize and facilitate the execution of the change in position.

In accordance with yet an additional feature of the invention, the die holder has at least one position more than the number of roller heads carried thereby. Even in the event of a multiple arrangement of roller heads, this succeeds in attaining a position in which none of the roller heads present is in working position. This facilitates the complete exchange of the dies and, in particular, the replacement of broken surface-hardening rollers and, under certain circumstances, the work involving the insertion of the workpiece can be facilitated also.

In accordance with another aspect of the invention, there is provided a rolling machine with a driving mechanism for a workpiece to be rolled and with at least one movable rolling device comprising a pair of arms hinged to one another and connected kinematically with a power actuating device for generating a rolling force. Such a construction permits the exertion of great rolling forces on the workpiece when the available space is limited, these rolling forces being cancelled out mutually on the workpiece itself so that an additional, undesired, radial load on the workpiece stemming from the rolling force is avoided. It must be emphasized at this juncture, that joining the arms in scissors fashion does not have to mean that a joint be present somewhat in the center of the arms. It is quite possible to place the joint, for example, also at one end of the arms and thus join the arm ends to one another. The other ends of the arms then carry the dies, and it is then possible to connect a power actuating device kinematically to these arms on one or the other side of the dies for generating the rolling force. Such a construction creates favorable lever ratios for generating the rolling force. In other words, and this is noted expressly, the scissorslike connection hinging the arms to one another does not necessarily have to be constructed as shown in the drawing, although such a construction may also be especially purposeful. Basically, no scissorslike connection at all has to be provided, of course; rather, it is also possible to guide and move the carriers, for example, parallel to one another and to connect them kinematically to a power actuating device, so that the die carriers can be moved parallel towards one another and away from one another.

In accordance with a concomitant feature of the invention the rolling device has at least one element of a group consisting of rolling and backing elements, respectively arranged in fixed position relative to a die carrier associated therewith. It may be advantageous for certain applications to change rolling elements and/or backing elements or to bring them, respectively, into and out of the working position by repositioning the entire rolling device accordingly. The rolling elements and/or backing elements must then be disposed in fixed position relative to the associated die carrier.

Other features which are considered as characteristic for the invention are set forth in the appended claims.

Although the invention is illustrated and described herein as embodied in a rolling apparatus for surface hardening or smoothing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings in which.

Figure 4:
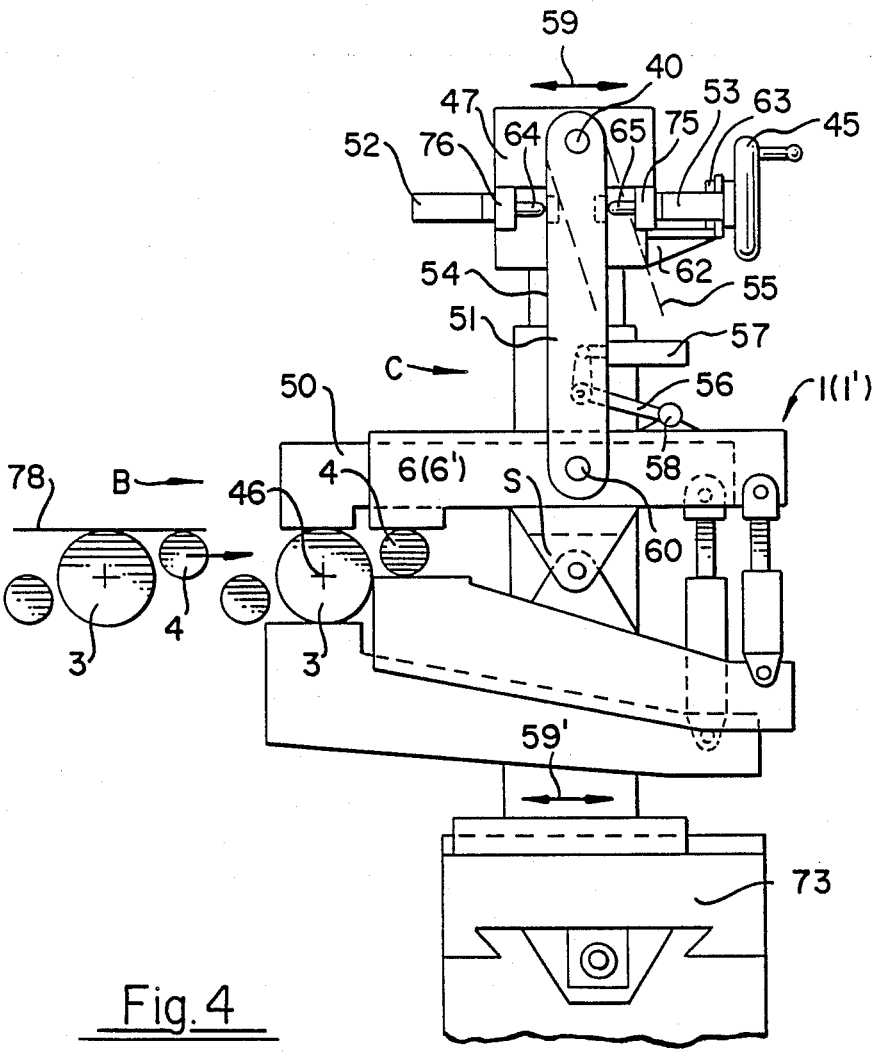
FIG. 4 is a side elevational view of a surface-hardening rolling apparatus with a support device and a crossbar constructed in accordance with the invention.
Figure 5:
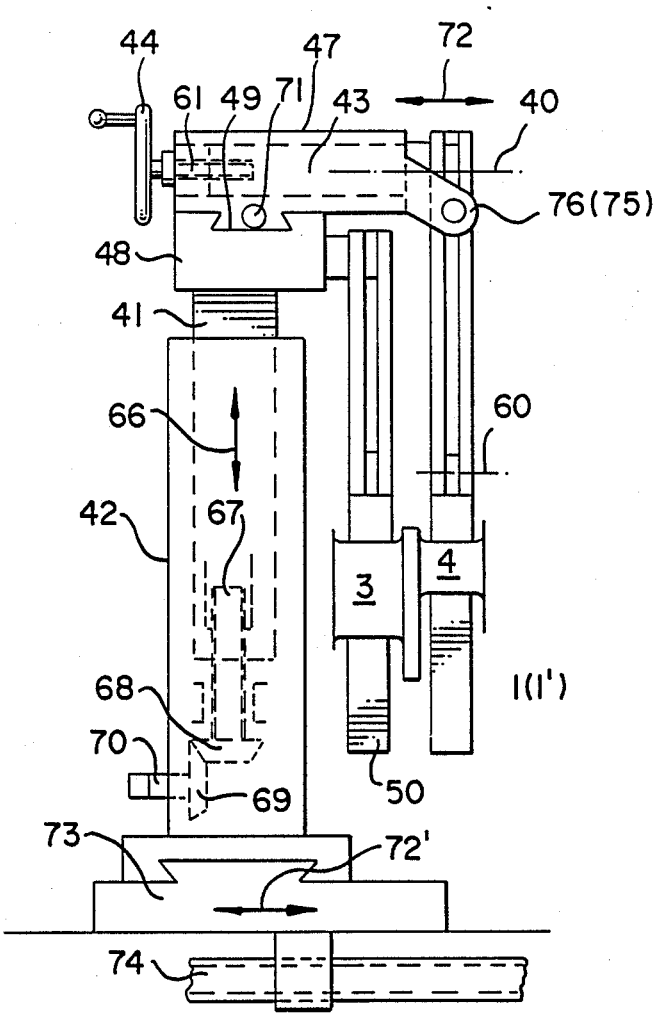
FIG. 5 is a front elevational view of FIG. 4 as seen in the direction of the arrow B.
Figure 6:
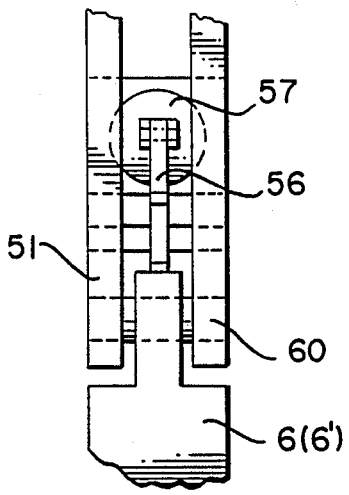
FIG. 6 is a fragmentary front elevational view of FIG. 4 as seen in the direction of the arrow C.

Referring now to the drawing and first, particularly, to FIGS. 4, 5 and 6, thereof, there is shown a surface-hardening rolling apparatus 1 or 1' pivotally suspended in the plane of the drawing by means of a pivot pin 60 from a pivot arm 51. The pivot arm 51 formed of two parallel legs carries a lever 56 which is also pivotally disposed in the plane of the drawing, and is operatively connected to a fluid or flow medium cylinder 57 likewise fastened to the pivot arm 51. A free end 58 of the lever 56 can be pressed by means of the fluid cylinder 57 against the surface-hardening rolling device 1 and 1', respectively, in the manner apparent from FIG. 4, thereby causing the surface-hardening rolling device to execute a pivoting movement about the pivot pin 60 in the plane of the drawing. With this pivoting motion, the surface-hardening rolling device is to be swung into the position shown in FIG. 4 which is required for a new setup to accommodate another crankshaft type and in order to apply the devices to the bearing locations to be rolled.

The surface-hardening rolling devices 1 and 1', respectively, are thereby disposed so that their center of gravity S is located in front of the pivot pin 60 in the manner shown in FIG. 4 so that the dead weight of the respective surface-hardening rolling device will press it against the free end 58 of the lever 56. During the rolling operation, the free end 58 of the lever 56 is swung away so that the freedom of motion of the respective surface-hardening rolling device 1 and 1', respectively, is not interfered with.

The pivot arm 51 in turn is suspended from a slide 47 so as to pivot about a pivot about a pivot pin 40 disposed parallel to the pivot pin 60. The slide 47 is guided in a slide carrier 48 with slide guideways 49 so as to be movable transversely to the crankshaft axis 46. The slide carrier 48, in turn, is carried by a support element 41 which is constructed as circular guide and disposed in a standard 42 so as to be movable vertically in a travel direction represented by the double-headed arrow 66 (FIG. 5). The support element 41 may be equipped for this purpose, at an inner lower end thereof, with a threaded nut cooperating with a threaded spindle 67. The threaded spindle 67 is mounted inside the standard 42 so that it can rotate yet not be axially displaceable, and it has a bevel gear 68 which meshes and cooperates with a matching bevel gear 69 of an adjusting device 70. In the embodiment of FIG. 5, the adjusting device 70 is constructed as a shaft with a square cross section so that this shaft can be turned by a wrench or a handwheel at the square section. Of course, a suitably controlled motor may also be used there to achieve automation.

To be able to set the surface-hardening rolling device 1 or 1' to a different crankshaft stroke, the slide 47 can be set transversely to the crankshaft axis 46 in the slide guideways 49 of the slide carrier 48. For this purpose, there is provided on the slide carrier 48 an extension arm 62 to which there is rotatably mounted a handwheel of an adjusting drive 45. This handwheel is connected to a threaded spindle 63 which engages a matching thread 71 of the slide 47 so that the slide 47 is moved radially in accordance with the rotation of the handwheel 45. In this case again, an appropriately controlled motor drive may, of course, be provided instead of the handwheel to achieve automation.

As is plain particularly from FIG. 4, besides the surface hardening rolling device 1 or 1' for the machining of the connecting rod journals, the apparatus also has a fixed rolling device 50 for machining a main bearing 3. As is easily recognized in FIG. 5, this rolling device 50 is attached to the slide carrier 48 so as to be slightly yielding. The slide 47, constructed as a circular guideway, is guided in the slide carrier 48, as described hereinbefore and, in turn, carries the slide 43 which has an extended shaft 40 on which the pivot arm 51 is disposed, as also described hereinbefore. This slide 43 is disposed in the slide 47 so as to be movable in the direction of an arrow 72. This is achievable via the adjusting drive 44, constructed as a handwheel in the embodiment of FIG. 5, and via the threaded spindle 61 which is connected to the handwheel and engages in a matching thread of the slide 43. The handwheel 44 with the threaded spindle 61 is mounted in the slide 47 so that it can turn, yet not be movable axially so that the slide 43 is moved axially when the handwheel 44 is suitably turned. This makes it possible to change the lateral spacing between the rolling device 1 and 1', respectively, and the rolling device 50 so that the rolling devices of the apparatus can be set to different bearing distances of a crankshaft to be rolled. Of course, the handwheel 44 may be replaced, in this case too, by a suitable controlled motor drive, which also automates the aforedescribed adjustment also.

To bring the entire apparatus into working position or retract it out of working position, the entire apparatus is disposed on a bed carriage 73 so as to be movable transversely to the crankshaft axis in the direction of an arrow 59'. In a conventional manner not otherwise described in detail herein, the adjustments may be made, for example, via a fluid cylinder or via a threaded spindle with a manual or motor drive. While the movement of the slide 47 in the direction of the arrow 59 serves for timing the stroke of the crankshaft, the displacement of the entire apparatus on the bed carriage 73 in the direction of arrow 59' is necessary, as mentioned hereinbefore, to bring the entire apparatus into working position or retract it out of the working position.

By moving the slide 43, the positions of the rolling device 50 and the rolling device 1 or 1' relative to one another can be set so that the rolling devices can be adjusted to different bearing spacings between main bearings and connecting rod bearings of a crankshaft. If several main bearings and/or connecting rod bearings of a crankshaft have to be rolled, it is necessary to move the entire apparatus axially along the crankshaft axis 46 while retaining the positions of the rolling device 50 and the rolling device 1 or 1' relative to one another. This is achieved by moving the bed carriage 73 on the associated machine bed in the direction of the arrow 72'. To accomplish this, the bed carriage 73 may be moved on the bed via a threaded spindle 74 in the direction of arrow 72', in a conventional manner. This threaded spindle 74 may be controlled manually or via a suitably controlled motor drive so that the movement in the direction of the arrow 72' can also be automated.

Fastened to the slide 47 via brackets 75 and 76, fluid cylinders 52 and 53 are provided below the slide 47, one in front of and one behind the pivot arm 51. The piston rods 64 and 65 of the respective fluid cylinders, each acting in opposite direction, can be brought into contact with the pivot arm 51. To drive the pivot arm 51 into a first pivoted position 54, the fluid cylinder 53 is operated with a greater force than the other fluid cylinder 52, and the piston rod 65 is extended to its stop. The pivot arm 51 has then reached its first pivoted position 54. For locking-in this first pivoted position 54, the piston rod 64 of the fluid cylinder 52 is driven against the pivot arm 51, but with less force than the force of the piston rod 65 so that the pivot arm 51 is clamped, and thus locked, between the piston rods 65 and 64 in the first pivoted position 54. It is in this pivoted position that the surface-hardening rolling devices can be fed to the bearing locations to be rolled.

The pivot arm 51 can also travel, however, into a second pivoted position 55 in which the piston rod 65 of the fluid cylinder 53 is retracted completely and the piston rod 64 of the fluid cylinder 52 is extended so far that the pivot arm 51, due to its pivoting motion, again makes contact with the retracted piston rod 65. The second pivoted position 55 has then been reached. This makes it possible for the respective surface-hardening rolling device alone to be swung out of the working range of the apparatus also, without having to retract the entire apparatus out of the working position and without having to change the basic setup of the apparatus. If the second pivoted position 55 remains insufficient for this purpose, the lever 56 may also be swung out additionally so that the free end 58 is no longer in contact with the surface-hardening rolling device 1 or 1' and the latter flaps downwardly due to the location of the center of gravity S in the drawing plane. This makes it possible, while maintaining the setup or positioning of the apparatus, also to use the rolling device 50 alone for the machining of only one main bearing 3. This may be advantageous, particularly if there is any intention of executing a straightening operation simultaneously with the rolling apparatus by means of the surface-hardening process.

Despite the fixed position of the devices 50 and 1 or 1' relative to one another in vertical direction it is possible, in a relatively simple manner, to set the apparatus also to varying diameters of the main bearing journal and or the connecting rod bearing journal. Diagrammatically shown in a cross sectional view to the left-hand side of the entire apparatus in FIG. 4 is a crankshaft with a main bearing 3 and two connecting rod bearings 4. In order that the entire device can be brought into working position in opened condition so that the main bearing 3 can be machined by the rolling device 50 and a connecting rod bearing 4 by the rolling device 1 or 1', the connecting rod bearing 4 must be turned in the machine in which the crankshaft is chucked and which is otherwise not shown in great detail, so that a plane 78 which extends parallel to the direction of the arrow 59' is tangent to both the main bearing 3 and the connecting rod bearing 4. Once this position is reached, the entire device can be moved simply by shifting it in the direction of arrow 59, on the one hand, over the main bearing 3 and, on the other hand, over the connecting rod bearing 4, and the rolling devices 50 and 1 or 1' can be closed to execute the rolling operation. If the diameter of the connecting rod bearing is different in a next crankshaft to be machined, all that is then needed is to change the angle of rotation of the crankshaft accordingly in the respective machine which is not otherwise shown in detail so that the plane 78 again forms a tangent to both the main bearing 3 and the connecting rod bearing 4. But if the diameter of the main bearing 3 changes, the plane 78 will travel upwardly vertically because of the fixed center of the machine chucking the crankshaft so that a corresponding vertical adjustment of the support element 41 must be made in the direction of the arrow 66.

When the crankshaft types change, it also frequently occurs that, together with the change in crankshaft type, not only the stroke lengths and the angular positions of the crank journals, but also the fillet radii is to be rolled, the diameters of the bearing locations to be rolled and the bearing widths of the bearing locations to be rolled change either simultaneously or singly. This will then require changing the affected dies, which must be performed manually according to the state of the art. A supplemental development of the machine according to the invention is intended to eliminate this drawback also and ensure an automatic adaptation of the machine to the described further changes of the various dimensions on different crankshafts. To this end, the respective surface-hardening rolling device must be appropriately constructed.

Figure 1:
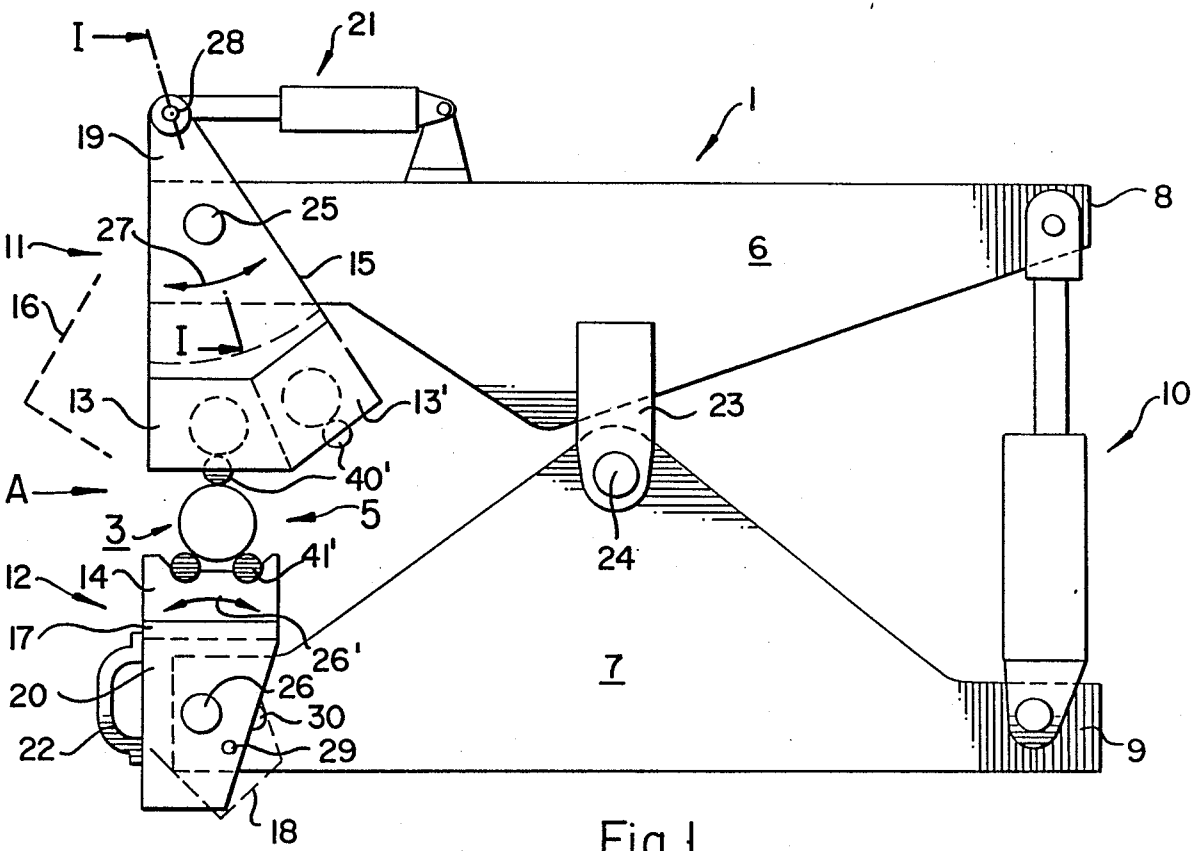
FIG. 1 is a side elevational view of one embodiment of a surface-hardening rolling apparatus according to the invention.
Figure 2:
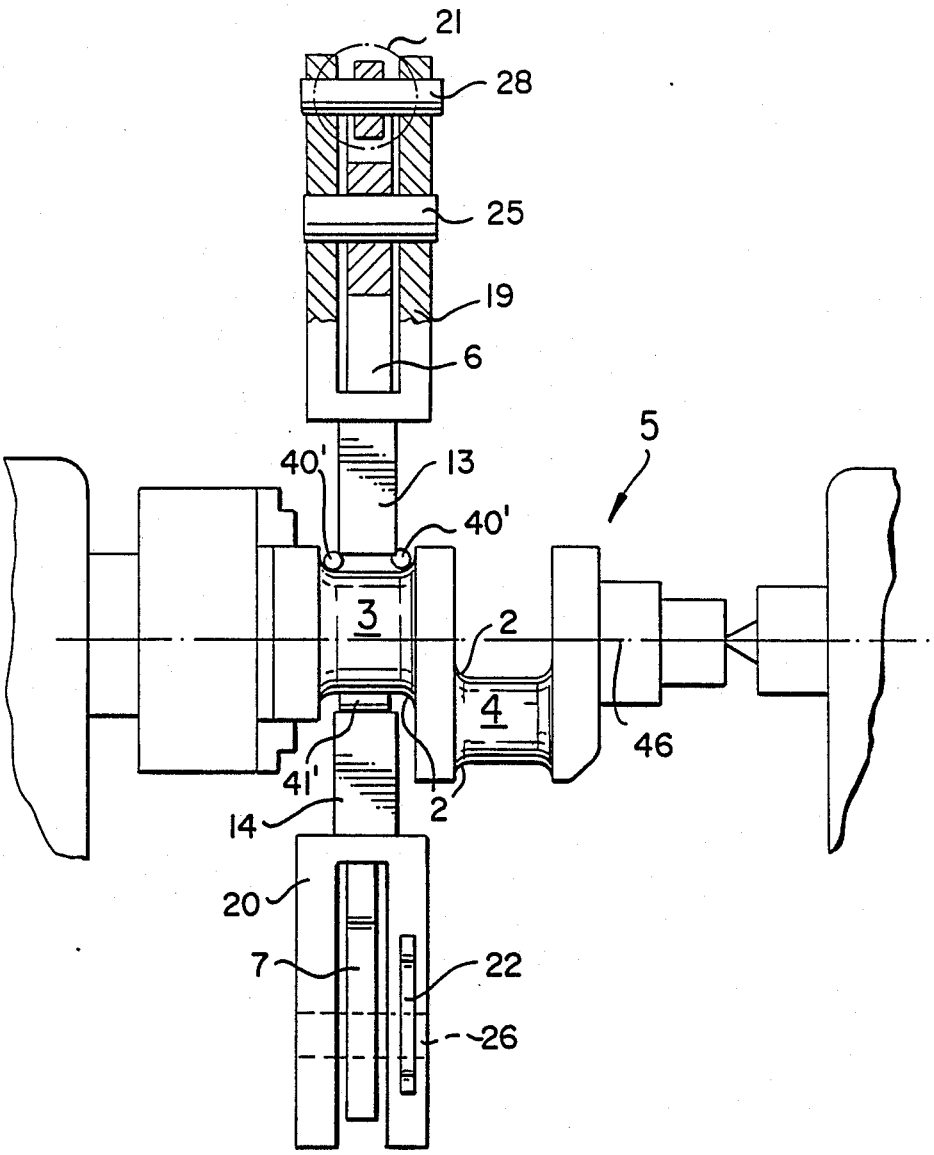
FIG. 2 is an enlarged front elevational view of FIG. 1 as seen in the direction of the arrow A.
Figure 3:
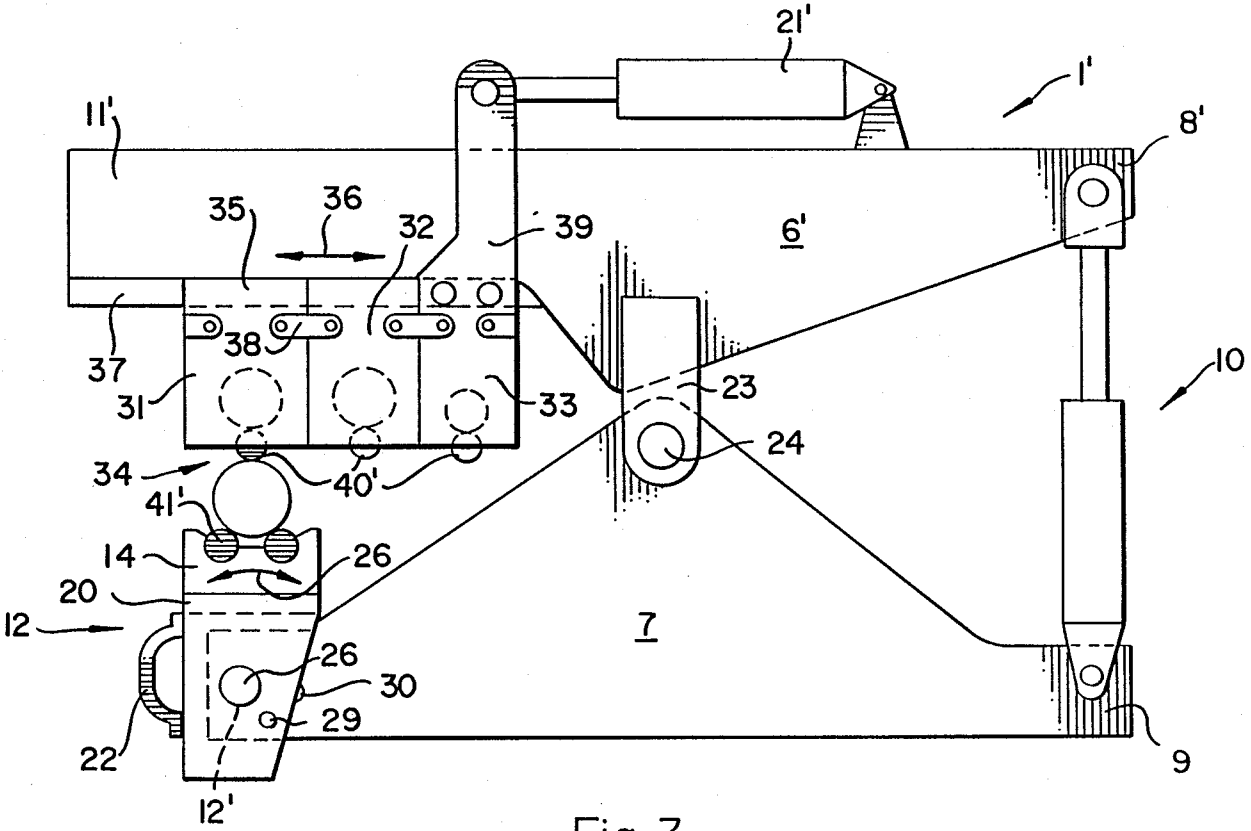
FIG. 3 is a view like that of FIG. 1 of another embodiment of the apparatus.

The construction necessary for such surface-hardening rolling devices is illustrated in FIGS. 1 through 3. The surface-hardening rolling device 1 is formed primarily of two arms 6 and 7. These arms 6 and 7 may be hinged to one another in conventional scissors-like manner via plates or webs 23 and a pivot pin 24. Disposed at mutually opposite rear ends 8 and 9 in a likewise conventional manner is a piston/cylinder unit 10 which moves the arms 6 and 7 in a manner similar to that for a pair of pliers or scissors. According to the present state of the art, a respectively required roller head is disposed at an end 11 of the arm 6 opposite the end 8 thereof and at an end 12 of the arm 7 opposite the end 9 thereof. In the surface hardening rolling device according to the invention, on the other hand, pivot pins 25 and 26, respectively, are provided thereat which articulatingly support forkshaped levers 19 and 20, respectively. The levers 19 and 20 can thus pivot freely about the pivot pins 25 and 26, respectively, as indicated by the arrows 27 and 26'.

A piston rod of a piston/cylinder unit 21 is connected to one end of the lever 19 via an articulating joint 28 while a cylinder of the piston/cylinder unit 21 is braced against the arm 6. In the indexing position shown in FIG. 1, the lever 19 is in an angular position 15. Disposed at the other end of the lever 19 opposite the one end thereof are conventional surface-hardening rolling dies 13 and 13' constructed as double dies in the illustrated embodiment of FIGS. 1 and 2. In the angular position 15 of lever 19, the surface-hardening roller head 13 is in working position.

The backing roller head 14 mounted on the lever 20 is disposed in a conventional manner opposite the surface-hardening roller head 13. The angular position 17 of the lever 20 keeps the backing roller head 14 in working position so that fillet or transition radii 2 can be rolled on the main bearing 3. This requires that the levers 6 and 7 be moved by the piston/cylinder unit 10 in a conventional manner so as to cause the surface-hardening roller head 13 and the backing roller head 14 to contact the respective bearing points of the crankshaft 5. Of course, it is not only the main bearing 3 of the crankshaft 5 which can be surface-hardened in this manner, but also equally as well the connecting rod bearing 4 in the region of the fillets 2 thereof. All that is required is that an appropriate device be additionally provided. The multiple arrangement of such devices, however, has become known heretofore from the hereinafore cited literature pertaining to the state of the art. Therefore, a detailed description of such a multiple arrangement is believed to be unnecessary here. The cited literature pertaining to the state of the art may be referred to in this context. It is also possible, however, to move the apparatus 1 and 1', respectively, axially from machining site to machining site, as indicated by the arrow 42 in FIG. 2.

To machine the crankshaft 5, it may be chucked between centers, as shown in FIG. 2 and centrally driven so that the surface-hardening rolling device 1 does not have to be suspended via master components or shafts. As an alternative, however, it is possible as well to mount the crankshaft 5 in the surface-hardening rolling devices 1 without centers and to guide and drive the surface-hardening rolling devices 1 via master shafts.

Machining of the crankshaft can then be performed in a manner already known in the state of the art. If a crankshaft with, for example, different fillet radii should then arrive as the next workpiece, the surface-hardening roller head 13' may be adapted for this task. In order to be able then to surfaceharden the crankshaft with the different fillet radii 2, the piston/cylinder unit 21 is actuated so that its piston rod retracts. This causes the lever 19 to move from the angular position 15 to the angular position 16 represented by broken lines. This brings the surface-hardening roller head 13' into working position, and the crankshaft 5 with the different radii can be rolled by means of the rolling elements 40. The pivoting motion of the lever 19 in the direction of the arrow 27, of course, is by no means restricted to the two indexing positions described with respect to the embodiment of FIGS. 1 and 2. More than two indexing positions may be provided. By the same token, more than two surface-hardening roller heads, also with respectively different rolling elements 40, may be used. Depending upon the particular use or application, it is also sensible to provide only a single surface-hardening roller head 13, for example, when the then possible outwardly swinging motion via the lever 19 should only or preferably additionally serve the purpose of simplifying the die change for the die 13 or, in case of fracture or failure of the rolling elements 40, of simplifying the replacement of the rolling elements by improving the accessibility thereof. Such an outwardly swinging motion, however, can also simplify the insertion of the work-piece.

The backing roller head 14 can also be pivoted, for example, by means of a handle 22, in the direction of arrow 28 from the angular position 17, which represents the working position, into the angular position 18. All that is required to accomplish this is the removal of the locking bolt 29 so that the lever 20 can then be pivoted effortlessly by means of the handle 22. The locking bolt 29 is then reinserted in the angular position 18 and is then seated in a hole 30 formed in the arm 7. In this pivoted position, the backing roller head 14 can be exchanged effortlessly. It is also conceivable, however, to construct the lever 20 like the lever 19 so that the lever 20 can carry several different backing roller heads for different bearing shapes.

A surface-hardening rolling device 1' according to FIG. 3 is essentially of a construction quite similar to that of the aforedescribed surface-hardening rolling device of FIGS. 1 and 2. The arm 7 with the backing roller head 14, which is mounted on the arm 7 via the lever 20 so as to pivot about the pivot pin 26, can be of exactly the same construction as has already been described in connection with FIG. 1. This lever 7 is again hinged to an arm 6' by means of the pivot pin 24 and the plate or web 23, and the rear ends 8' and 9 of the arms 6' and 7, respectively, are connected to a piston/cylinder unit 10 which is to effect the pivoting motion of the arms 6' and 7 relative to one another and which generates the required rolling force.

The construction of the arm 6' of FIG. 3 differs from that of the arm 6 of FIG. 1. In the region of the front end 11' of the arm 6', it has on the underside thereof a slide guideway 37 on which one or more slides 35 may be disposed. The one or more slides 35 are movable in the direction of the double-headed arrow 36. In the embodiment of FIG. 3, the slides 35 carry surface-hardening roller heads 31, 32 and 33 which, in turn, contain rolling elements 40. Because several slides 35 are provided in the embodiment of FIG. 3, the surface-hardening roller heads 31 through 33 are interconnected by brackets or straps 38. The surface-hardening roller head 31 is shown in working position in FIG. 3, while the surface-hardening roller heads 32 and 33 are shown available for a roller-head change.

To execute a shifting motion of the roller heads 31 through 33 on the slide guideway 37, the roller head 33 with its associated slide 35 is connected to the piston/cylinder unit 21' via an arm 39. A retracting or extending motion of the piston rod of this piston/cylinder unit 21' effects a corresponding motion of the slides 35 and, hence, of the roller heads 31 through 33 in the direction of the arrow 36. Thereby, any desired roller head can be brought into or out of the working position 34. In the respective working position 34, the roller head which is in working position can be locked mechanically or kept therein by a position control of the piston in the piston/cylinder unit 21'.

It is quite possible with this construction to make the respective slide 35 an integral part of the roller head to be associated therewith. It is also possible to construct several roller heads as one structural unit so that only one roller head is present as a subassembly which, however, has several work stations.

By the same token, it is also possible, of course, to use a roller head arrangement, as described hereinbefore with regard to the lever 6', also in the form of backing roller heads on the arm 7. All that is then necessary is to construct the front end 12' of the arm 7 like the front end 11' of the arm 6'.

The aforedescribed surface-hardening rolling device may be used both in surface-hardening rolling machines according to the state of the art cited at the introduction hereto and also as a separate or individual apparatus.

It is also possible to dispose the rolling element 40 and/or the backing elements 41 in fixed position relative to the associated die carrier and to move the die carrier itself or the entire apparatus in order to effect the change in position, or to change its position in another way. Of course, it is also possible to provide additionally for a die carrier or the entire apparatus to be movable or changeable in position.

There is claimed:

1. Surface-hardening and smoothing rolling apparatus comprising at least one movable rolling device at least including a die carrier with at least one backing element and a die carrier with at least one rolling element, as well as at least one additional rolling devices, said movable and additional rolling device being carried by a standard disposed on a slide, said standard being movable relative to a crankshaft to be rolled, said movable rolling device being arranged so that the position thereof is changeable relative to that of said additional rolling device in a radial plane of the crankshaft to be rolled and independently of a center of rotation of the crankshaft.

2. Rolling apparatus according to claim 1, wherein said movable rolling device is arranged so that the position thereof is changeable linearily in at least two independent coordinate directions in said radial plane.

3. Rolling apparatus according to claim 1, wherein at least one movable rolling device is disposed so as to be movable in a coordinate direction perpendicularly to said radial plane.

4. Rolling apparatus according to claim 1, wherein at least one movable rolling device is arranged so that the position thereof is changeable in said radial plane independently of movement of said slide.

5. Rolling apparatus according to claim 4, including a vertically movable and adjustable support element for carrying said rolling devices.

6. Rolling apparatus according to claim 1, including slide means for performing a change in position of at least said movable rolling device.

7. Rolling apparatus according to claim 1, wherein said movable rolling device is arranged so that the position thereof is changeable relative to said additional rolling device in axial direction of said crankshaft.

8. Rolling apparatus according to claim 6, wherein said slide means are disposed on a slide carrier which is, in turn, disposed on a support element, said support element being disposed on said standard.

9. Rolling apparatus according to claim 8, wherein said support element is vertically movable and adjustable on said standard.

10. Rolling apparatus according to claim 8, wherein said standard and said support element are constructed as a clylindrical guide, said support element being axially displaceable in yet constrained against rotation relative to said standard.

11. Rolling apparatus according to claim 1, wherein said movable rolling device is suspended from a pivot arm so as to be pivotable about a first pivot pin parallel to the axis of the crankshaft, said pivot arm, in turn, being suspended from the apparatus so as to be pivotable about a second pin parallel to said first pin.

12. Rolling apparatus according to claim 10, wherein said second pivot pin continues as a cylindrical guide and forms another slide displaceably guided in a corresponding bore formed in the first-mentioned slide.

13. Rolling apparatus according to claim 10, including two fluid cylinders operatively acting upon said pivot arm in opposite directions for pivoting said pivot arm into a given position and maintaining it there so as to lock said pivot arm in said given position.

14. Rolling apparatus according to claim 13, wherein one of said two fluid cylinders has a first end position defining a first pivoted position and a second end position defining a second pivoted position of said pivot arm, said other of said fluid cylinders being operative with less force than said one fluid cylinder at least for locking in said first pivoted position.

15. Rolling apparatus according to claim 14, including a lever pivotally mounted on said pivot arm and actuatable by a fluid cylinder likewise disposed on said pivot arm, said lever having a free end pressable against the rolling device associated therewith in order to bring said rolling device into a given pivoted position.

16. Rolling apparatus according to claim 1 the rolling carriage is in combination with and disposed on a bed carriage of a machine for receiving and driving a crankshaft, the apparatus and said bed carriage being movably mounted on the bed of the machine.

17. Rolling apparatus according to claim 1, wherein at least an additional one of the elements consisting of a rolling element and a backing element is carried by at least one of said die carrier, at least one rolling element being movably connected relative to the respective carrier so as to be changeable with respect to said carrier into at least two positions of which at least one position is an active position, and at least one of the elements being connectible kinematically to a power actuator.

18. Rolling apparatus according to claim 17, wherein at least one of the elements consisting of said rolling element and said backing element is arranged so as to be changeable in position on the respective carrier.

19. Rolling apparatus according to claim 17, wherein said rolling element and said backing element, respectively, is an element of a roller head.

20. Rolling apparatus according to claim 19, including a respective independent roller head for each of said rolling elements.

21. Rolling apparatus according to claim 19, including a respective independent roller head for each of said backing elements.

22. Rolling apparatus according to claim 19, wherein said additional element is a rolling element forming with said one rolling element a respective rolling element pair, and including a respective independent roller head for said rolling element pair.

23. Rolling apparatus according to claim 19, wherein said additional element is a backing element forming with said one backing element a respective backing element pair, and including a respective independent roller head for said backing element pair.

24. Rolling apparatus according to claim 19, wherein each of said roller heads is so disposed on a die carrier associated therewith as to be changeable in the position thereof.

25. Rolling apparatus according to claim 17, including a die holder provided on at least one of said die carriers, said die holder being changeable from one to another pre-determinable position, with at least one element of said rolling element and said backing element being movable into said positions by means of said die holder, at least one of said elements in working position being connectible kinematically to said power actuating device.

26. Rolling apparatus according to claim 25, wherein said die holder is constructed as a roller head for said element.

27. Rolling apparatus according to claim 26, wherein said die holder has at least one position more than the number of roller heads carried thereby.

28. Rolling apparatus according to claim 25, wherein at least one die holder carries at least one roller head.

29. Rolling apparatus according to claim 28 including at least two roller heads disposed so as to be changeable into a plurality of positions, at least one of said positions being said working position.

30. Rolling apparatus according to claim 29, wherein said roller heads are disposed on a guideway for changing the position thereof.

31. Rolling apparatus according to claim 29, including actuating means for performing the change in position of said roller heads.

32. Rolling apparatus according to claim 31, wherein said actuating means is a fluid-actuated piston/cylinder unit.

33. Rolling apparatus with a driving mechanism for a workpiece to be rolled and with at least one movable rolling device according to claim 17 comprising a pair of arms hinged scissorslike to one another and connected kinematically with a power actuating device for generating a rolling force.

34. Rolling apparatus according to claim 33, wherein said rolling device has at least one element of a group consisting of rolling and backing elements, respectively arranged in fixed position relative to a die carrier associated therewith.

* * * * *